US007714464B2

(12) United States Patent
Tsai et al.

(10) Patent No.: US 7,714,464 B2
(45) Date of Patent: May 11, 2010

(54) LOAD CONTROL MODULE

(75) Inventors: Wen-Kuei Tsai, Taipei County (TW); Chun-Chien Wang, Taipei County (TW)

(73) Assignee: GE Investment Co., Ltd., Taipei (TW)

( * ) Notice: Subject to any disclaimer, the term of this patent is extended or adjusted under 35 U.S.C. 154(b) by 362 days.

(21) Appl. No.: 11/871,138

(22) Filed: Oct. 11, 2007

(65) Prior Publication Data

US 2009/0058195 A1 Mar. 5, 2009

(30) Foreign Application Priority Data

Aug. 28, 2007 (CN) ..... 2007 1 0148134

(51) Int. Cl.
*H01H 33/59* (2006.01)

(52) U.S. Cl. ..... 307/140; 362/85

(58) Field of Classification Search ..... 307/140, 307/141; 362/84; 323/234
See application file for complete search history.

(56) References Cited

U.S. PATENT DOCUMENTS 3,706,913 A * 12/1972 Malatchi ..... 315/292
4,425,628 A * 1/1984 Bedard et al. ..... 710/8
4,965,492 A * 10/1990 Boldwyn ..... 315/156
5,059,871 A * 10/1991 Pearlman et al. ..... 315/316
5,719,474 A * 2/1998 Vitello ..... 315/307
5,955,847 A * 9/1999 Rothenbuhler ..... 315/289
7,273,983 B1 * 9/2007 Rintz ..... 174/66

* cited by examiner

*Primary Examiner*—Albert W Paladini
(74) *Attorney, Agent, or Firm*—Jianq Chyum IP Office

(57) ABSTRACT

A load control module suitable for an electrical equipments driven by an operation of a switch is disclosed. The load control module includes an energy storage unit, a signal transforming unit, a first control unit and a second control unit. The energy storage unit still outputs a reserved voltage for a predetermined time during the switch is turned off. The signal transforming unit and the first and the second control unit are driven by the reserved voltage. With a different switching speed of the switch, the second control unit may operate in coordination with the actions of the signal transforming unit and the first control unit to regulate a level of the control voltage, or maintain the level of the control voltage in a current state. The electrical equipments may perform diversified control functions under control of the load control module operated in coordination with an operation of the switch.

12 Claims, 7 Drawing Sheets

LOAD CONTROL MODULE

CROSS-REFERENCE TO RELATED APPLICATION

This application claims the priority benefit of Chinese application serial no. 200710148134.8, filed on Aug. 28, 2007. All disclosure of the Chinese application is incorporated herein by reference.

BACKGROUND OF THE INVENTION

1. Field of the Invention

The present invention relates to a load control module. More particularly, the present invention relates to a load control module allowing an electrical equipment to perform diversified control functions.

2. Description of Related Art

With discovering of electricity by an American Franklin in the 18th century, civilization of human beings advanced a big step. In today's world, application of the electricity not only contributes productions of social materials, but also widely infiltrates human life in all dimensions. For example, the electrical equipments used in our daily life, such as illumination apparatus, air conditioner, electric fans, food heater . . . etc. are all driven by electric power for working normally.

During utilization of the electrical equipments, operation of the electrical equipments is generally controlled by a switch and a load control module, interactively. For example, FIG. 1 is a circuit block diagram illustrating an application of a conventional illumination apparatus. Referring to FIG. 1, the conventional illumination apparatus 100 includes a light-emitting diode (LED) 101 and a diode driver 102. Referring to FIG. 1 again, during operation, when the switch 110 is turned on, the conventional illumination apparatus 100 may work normally. Now, a conventional load control module 120 and the LED 101 may receive a supply voltage VS output from the switch 110, and the LED 101 may be driven by the supply voltage VS.

Correspondingly, the conventional load control module 120 converts the supply voltage VS output from the switch 110 into a control voltage VC having a fixed level. Then, the diode driver 102 may adjust a light source generated by the LED 101 to a fixed brightness according to the control voltage VC. On the other hand, when the switch 110 is turned off, the LED 101 and the load control module 120 are cut off from the power supply, and therefore the illumination apparatus 100 maintains a stop working mode, since the illumination apparatus 100 may not provide a light source normally.

According to the above description, operation mode of the conventional illumination apparatus 100 under interactive control of the switch 110 and the conventional load control module 120 can only be switched between a normal working mode and the stop working mode. During the normal working mode, the conventional load control module 120 can only adjust the light source generated by the conventional illumination apparatus 100 to the fixed brightness.

In other words, circuit performance of a general illumination apparatus or a electrical equipment under control of the switch and the conventional load control module is limited and cannot match a requirement of convenience. Therefore, how to operate the load control module in coordination with an operation of the switch so as to control the electrical equipments to perform diversified control functions has become one of the major subjects to various manufacturers during development of the load control module.

SUMMARY OF THE INVENTION

The present invention is directed to a load control module, which may operate in coordination with an operation of a switch for controlling an electrical equipment to perform diversified control functions.

The present invention provides a load control module for an electrical equipment, the electrical equipment is driven by an operation of a switch. The load control module includes an energy storage unit, a signal transforming unit, a first control unit and a second control unit. The energy storage unit determines whether or not to output a reserved voltage according to the operation of the switch, wherein when the switch is turned on, the energy storage unit converts a supply voltage output from the switch into a reserved voltage, and outputs the reserved voltage; and when the switch is turned off, the energy storage continuously outputs the reserved voltage for a predetermined time.

Moreover, the signal transforming unit transforms the supply voltage output from the switch into a counting signal when the signal transforming unit is activated. The first control unit filters and rectifies the counting signal to generate an rectified signal, wherein when a level of the rectified signal is switched to a second level, the first control unit latches the level of a clamping signal to the second level, and until the first control unit is reactivated, it may output the clamping signal having a first level.

On the other hand, the second control unit outputs a control voltage to control characteristic parameters of the electrical equipment when the second control unit is activated, wherein when the second control unit receives the clamping signal having the first level, the second control unit counts continuously in response to the counting signal, so as to adjust the level of the control voltage according to a counting result. When the second control unit counts up to a predetermined value or receives the clamping signal having the second level, the second control unit stops counting, such that the level of the control voltage may be switched to one of a plurality of predetermined levels according to an inverted signal of the rectified signal. It should be noted that the signal transforming unit, the first control unit and the second control unit are respectively coupled to the energy storage unit, and are driven by the reserved voltage.

In an embodiment of the present invention, the first control unit includes a filtering rectifier unit and a latching unit. The filtering rectifier unit filters and rectifies an output signal of the signal transforming unit for outputting the rectified signal. The latching unit outputs the clamping signal according to the rectified signal when the latching unit is activated, wherein when the level of the rectified signal is switched to the second level, the latching unit latches the level of the clamping signal to the second level until the latching unit is reactivated. Moreover, the latching unit is coupled to the energy storage unit, and is driven by the reserved voltage.

In an embodiment of the present invention, the second control unit includes a frequency divider, a counting unit, a rough adjusting unit, a multiplexer and a digital-to-analog converter. The frequency divider divides the frequency of the counting signal into a specific frequency to output a square wave signal when the frequency divider is activated. Moreover, the counting unit counts an accumulated value up to a predetermined value according to the square wave signal when the counting unit is activated, and when the counting unit counts up to the predetermined value or receives the clamping signal having the second level, the counting unit stops counting and generates an interrupt signal having the second level. On the other hand, the rough adjusting unit determines to output one of a plurality of level adjusting values according to the inverted signal of the rectified signal and the interrupt signal, so as to generate a specific adjusting value and a control signal, when the rough adjusting unit is activated. When the multiplexer receives the control signal, the multiplexer outputs the specific adjusting value; conversely, the multiplexer outputs the accumulated value. Accordingly, the digital-to-analog converter outputs the control voltage and converts the level of the control voltage according to the accumulated value or the specific adjusting value when the digital-to-analog converter is activated. It should be noted that the frequency divider, the counting unit, the rough adjusting unit, the multiplexer and the digital-to-analog converter are respectively coupled to the energy unit, and are driven by the reserved voltage.

In summary, in the present invention, the load control module may still operates continuously for the predetermined time under control of the energy storage unit when the switch is turned off. The signal transforming unit, the first control unit and the second control unit are driven by the reserved voltage. With a different switching speed of the switch, the second control unit may operate in coordination with the actions of the signal transforming unit and the first control unit to regulate the level of the control voltage, or maintain the level of the control voltage in the current state. Therefore, the electrical equipments may perform diversified control functions under control of the load control module operated in coordination with an operation of the switch.

In order to make the aforementioned and other objects, features and advantages of the present invention comprehensible, a preferred embodiment accompanied with figures is described in detail below.

DESCRIPTION OF EMBODIMENTS

Figure 1:
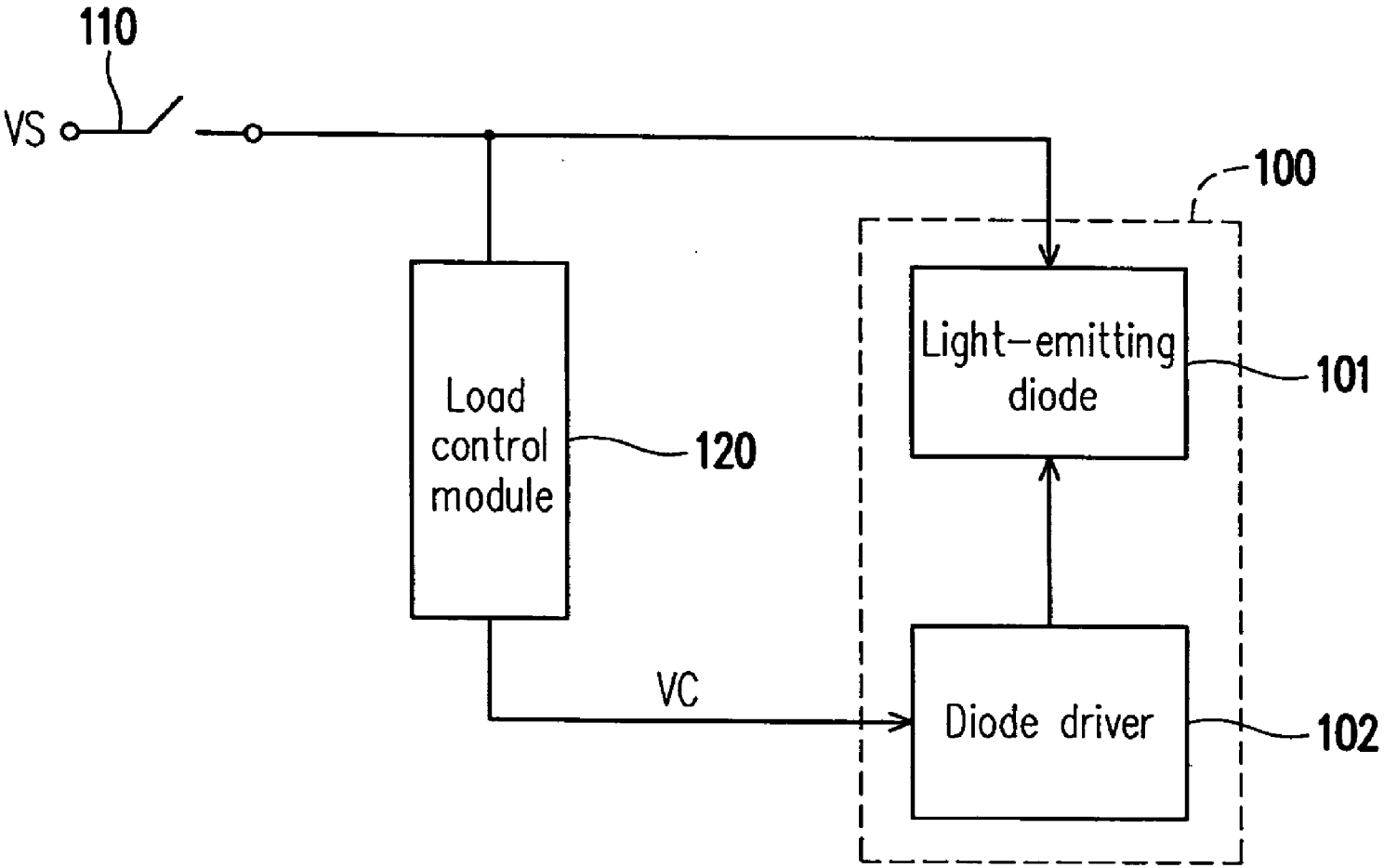
FIG. 1 (PRIOR ART)
FIG. 1 is a circuit block diagram illustrating an application of a conventional illumination apparatus.
Figure 2:
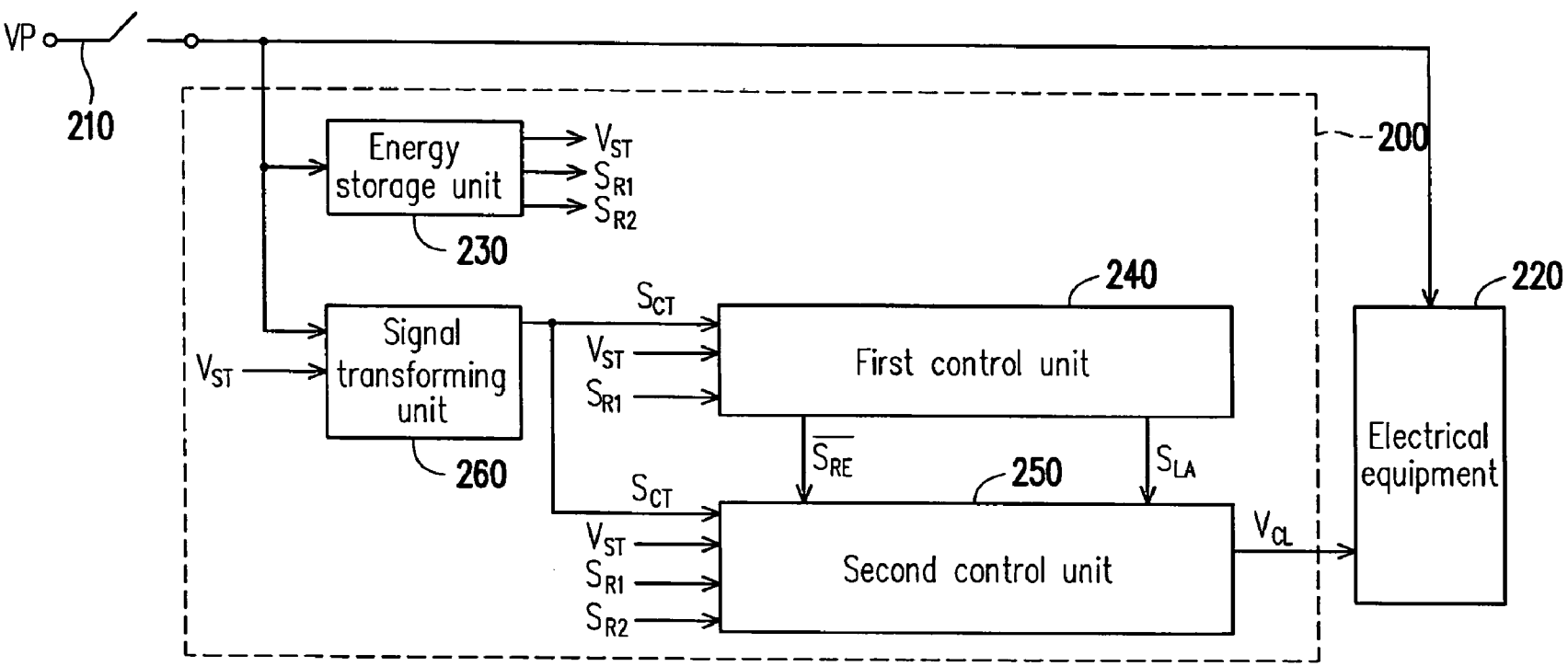
FIG. 2 is a circuit block diagram of a load control module according to an embodiment of the present invention.

FIG. 2 is a circuit block diagram of a load control module according to an embodiment of the present invention. The load control module 200 is suitable for an electrical equipment 220 driven by an operation of a switch 210. Moreover, the load control module 200 includes an energy storage unit 230, a first control unit 240, a second control unit 250 and a signal transforming unit 260. The energy storage unit 230 is coupled to the switch 210, the first control unit 240, the second control unit 250 and the signal transforming unit 260. The first control unit 240 is coupled to the signal transforming unit 260, and the second control unit 250 is coupled to the first control unit 240 and the signal transforming unit 260.

Figure 3:
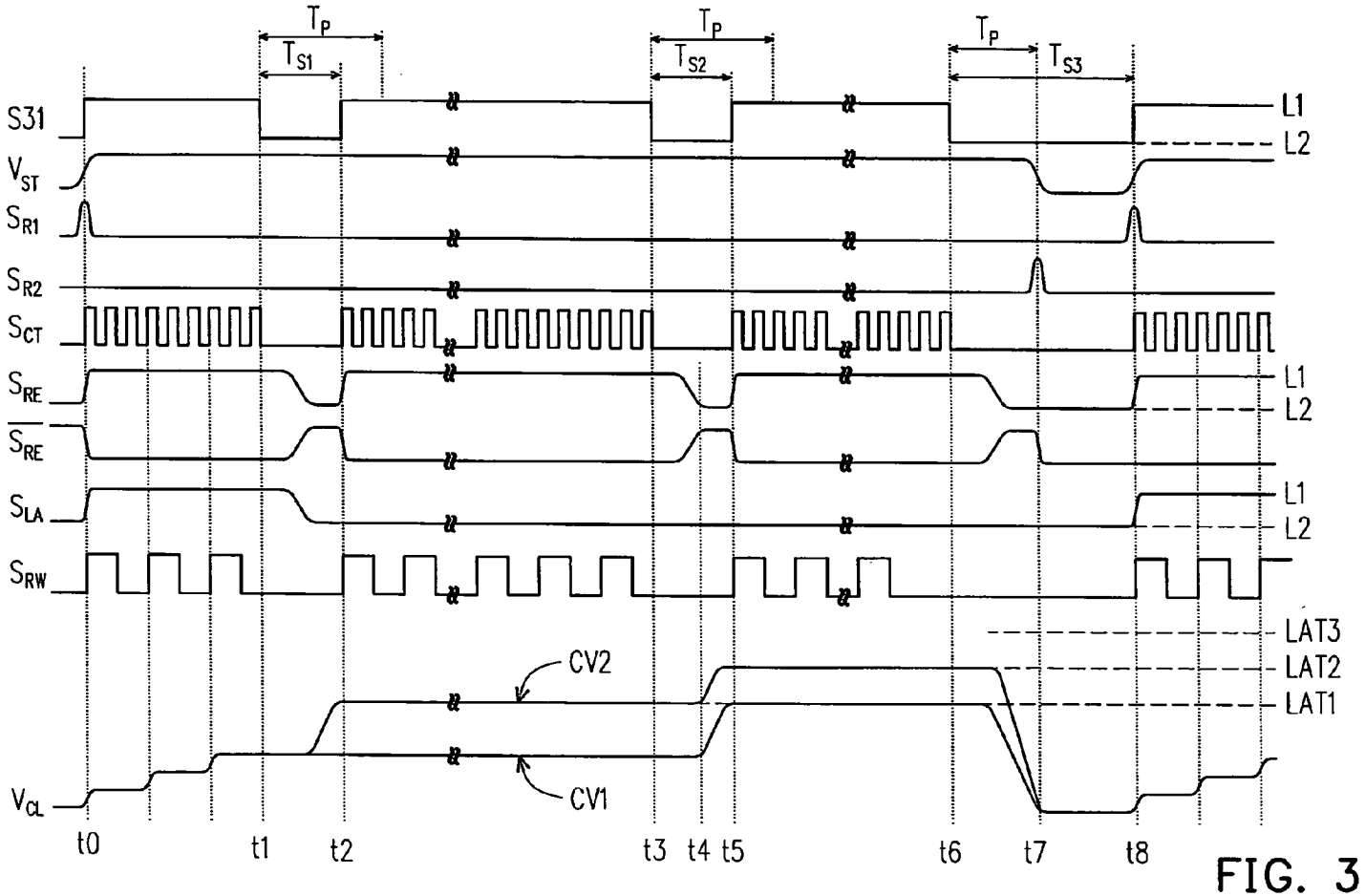
FIG. 3 is a timing diagram of waveforms according to the embodiment of FIG. 2.

FIG. 3 is a timing diagram of waveforms according to the embodiment of FIG. 2. Referring to FIG. 2 and FIG. 3, the switch 210 switches in response to a switching signal S31. For example, when the level of the switching signal S31 is switched to a first level L1, the switch 210 is turned on. Conversely, when the level of the switching signal S31 is switched to a second level L2, the switch 210 is turned off. In the present embodiment, the first level L1 is assumed to be logic 1, and the second level L2 is assumed to be logic 0. For convenience, the following embodiments will be described based on the aforementioned assumptions.

As to the operation mechanism of the load control module 200, the load control module 200 is operated in coordination to the action of the switch. When the switch 210 is turned on, the energy storage unit 230 converts a supply voltage VP output from the switch 210 into a reserved voltage $V_{ST}$, and outputs the reserved voltage $V_{ST}$ to the first control unit 240, the second control unit 250 and the signal transforming unit 260. Conversely, when the switch 210 is turned off, the energy unit 230 may continuously output the reserved voltage $V_{ST}$ for a predetermined time $T_P$. It should be noted that the energy storage unit 230 further outputs a first reset signal $S_{R1}$ during a high transition of the reserved voltage $V_{ST}$, and outputs a second reset signal $S_{R2}$ when the level of the reserved voltage $V_{ST}$ drops to a threshold value.

For example, at the beginning, i.e. at the time point $t_0$, the load control module 200 is activated, and starts to output the reserved voltage $V_{ST}$ and output the first reset signal $S_{R1}$ during the high transition of the reserved voltage $V_{ST}$. Then, during a time point $t_1$ and a time point $t_2$, since a time $T_{S1}$ is less than the predetermined time $T_P$, the energy storage unit 230 may continuously output the reserved voltage $V_{ST}$. Similarly, since a time $T_{S2}$ is less than the predetermined time $T_P$, the energy storage unit 230 may continuously output the reserved voltage $V_{ST}$ during a time point $t_3$ and a time point $t_5$. However, during a time point $t_6$ and a time point $t_8$, since a time $T_{S3}$ is greater than the predetermined time $T_P$, the energy storage unit 230 may continuously output the reserved voltage $V_{ST}$ for the predetermined time $T_P$, and stops outputting the reserved voltage $V_{ST}$ during a time point $t_7$ and the time point $t_8$. It should be noted that, during a process of continuous decreasing of the reserved voltage $V_{ST}$, when the level of the reserved voltage $V_{ST}$ drops to the threshold value (for example $0.5*V_{ST}$), the energy storage unit 230 further outputs a second reset signal $S_{R2}$.

Moreover, the first control unit 240, the second control unit 250 and the signal transforming unit 260 are all driven by the reserved voltage $V_{ST}$. Therefore, when the switch 210 is turned on, the first control unit 240, the second control unit 250 and the signal transforming unit 260 are then all activated; when the switch 210 is turned off, the first control unit 240, the second control unit 250 and the signal transforming unit 260 may only maintain an operation for the predetermined time $T_P$. Operation mechanism of the first control unit 240, the second control unit 250 and the signal transforming unit 260 will be described in detail below.

Please referring to FIG. 2 and FIG. 3, when the switching signal S31 is switched to the first level L1 at the time point $t_0$ in the beginning, the signal transforming unit 260 is activated, and transforms the supply voltage VP into a counting signal $S_{CT}$. Then, the first control unit 240 filters and rectifies the counting signal $S_{CT}$ to generate a rectified signal $S_{RE}$, and outputs a clamping signal $S_{LA}$ having the first level L1 according to the first reset signal $S_{R1}$.

On the other hand, the second control unit 250 is first reset in response to the first reset signal $S_{R1}$. Then, when the second control unit 250 receives the clamping signal $S_{LA}$ having the first level L1, the second control unit 250 counts continuously in response to the counting signal $S_{CT}$, so as to adjust the level of a control voltage $V_{CL}$ according to a counting result. For example, during the time point $t_0$ and the time point $t_1$, the second control unit 250 may continuously receive square waves from the counting signal $S_{CT}$, and adjust the level of the control voltage $V_{CL}$ when every three square waves is received.

It should be noted that the second control unit 250 stops counting only when the second control unit 250 counts up to a predetermined value or receives the clamping signal $S_{LA}$ having the second level L2. In other words, if the second control unit 250 does not count up to the predetermined value during the time point $t_0$ and the time point $t_1$, the second control unit 250 then stop counting by switching the clamping signal $S_{LA}$ to the level L2 after the time point $t_1$. Conversely, if the second control unit 250 counts up to the predetermined value during the time point $t_0$ and the time point $t_1$, the second control unit 250 maintains a non-counting state after the time point $t_1$. Moreover, during the non-counting period, the level of the control voltage $V_{CL}$ may be switched to one of a plurality of predetermined levels under control of the second control unit 250 according to an inverted signal $/S_{RE}$ of the rectified signal.

For example, assuming during the time point $t_0$ and the time point $t_1$, the second control unit 250 does not count up to the predetermined value, operation of the first control unit 240 and the second control unit 250 during the time point $t_1$ and the time point $t_8$ is then described in detail as below. At the time point $t_1$, the switching signal S31 is switched to the second level L2. During a time point $t_1$ and a time point $t_2$, since the rectified signal $S_{RE}$ may be switched to the second level L2 along with the variation of the waveform of the counting signal $S_{CT}$, the first control unit 240 may latch the level of the clamping signal $S_{LA}$ to the second level L2.

The second control unit 250 stops counting after the second control unit 250 receives the clamping signal $S_{LA}$ having the second level L2. In other words, during the time point $t_2$ and the time point $t_3$, the second control unit 250 may stop adjusting the level of the control voltage $V_{CL}$, and therefore the level of the control voltage $V_{CL}$ will stay unchanged during the time point $t_1$ and the time point $t_3$, shown as a curve CV1.

Next, when the switching signal S31 is switched back to the second level L2 at the time point $t_3$, the second control unit 250 is in the non-counting state at the present, and the level of the control voltage $V_{CL}$ may be switched to one of the predetermined levels LAT1~LAT3 under control of the second control unit 250 according to an inverted signal $/S_{RE}$ of the rectified signal. For example, as shown of the curve CV1, the level of the control voltage $V_{CL}$ is switched to the predetermined level LAT1 at the time point $t_5$.

Moreover, at the time point $t_6$, the switching signal S31 is switched back to the second level L2. Since the time $T_{S3}$ for the switch 210 being in a turned off state is greater than the predetermined time $T_P$, the load control module 200 may only operate continuously during the time point $t_6$ and the time point $t_7$, and will be disabled during the time point $t_7$ and the time point $t_8$. Correspondingly, when the load control module 200 maintains a disabled state, the second control unit 250 forces the level of the control voltage $V_{CL}$ being switched to the lowest level, and until the load control module 200 is reactivated at the time point $t_8$, the level of the control voltage $V_{CL}$ may be re-adjusted.

It should be noted that before entering the disable state, the second control unit 250 is first reset in response to the second reset signal $S_{R2}$. Moreover, when the load control module 200 is reactivated, the load control module 200 repeats the operations performed during the time to and the time point $t_8$.

In addition, assuming the second control unit 250 counts up to the predetermined value during the time point $t_0$ and the time point $t_1$, operation of the first control unit 240 and the second control unit 250 during the time point $t_1$ and the time point $t_8$ is then described in detail as below. At the time point $t_1$, the switching signal S31 is switched to the second level L2. During the time point $t_1$ and the time point $t_2$, since the second control unit 250 is now in the non-counting state, the level of the control voltage $V_{CL}$ may be switched to one of the predetermined levels LAT1~LAT3 under control of the second control unit 250 according to the inverted signal $/S_{RE}$ of the rectified signal. For example, as shown of the curve CV2, the level of the control voltage $V_{CL}$ is switched to the predetermined level LAT1 during the time point $t_2$ and the time point $t_3$.

Next, when the switching signal S31 is again switched back to the second level L2 at the time point $t_3$, the level of the control voltage $V_{CL}$ may be switched to one of the predetermined levels LAT1~LAT3 again under control of the second control unit 250 according to the inverted signal $/S_{RE}$ of the rectified signal. For example, as shown of the curve CV2, the level of the control voltage $V_{CL}$ is switched to the predetermined level LAT2 during the time point $t_5$ and the time point $t_6$.

Moreover, when the switching signal S31 is again switched back to the second level L2 at the time point $t_6$, the load control module 200 maintains the disabled state during the time point $t_7$ and the time point $t_8$, and the level of the control voltage $V_{CL}$ is switched to the lowest level. Before entering the disable state, the second control unit 250 is first reset in response to the second reset signal $S_{R2}$.

In summary, when the switching signal S31 is switched to the first level L1 at the time point $t_0$ in the beginning, the load control module 200 starts to continuously adjust the level of the control voltage $V_{CL}$, until a turn-on state of the switch 210 is quickly switched in response to the switching signal S31, i.e. until the time point $t_1$, the load control module 200 may adjust the level of the control voltage $V_{CL}$ according to the inverted signal $/S_{RE}$ of the rectified signal. On the other hand, at the time point $t_6$, the switching signal S31 is switched to the second level L2. Since the time $T_{S3}$ for the switch 210 being in a turned off state is greater than the predetermined time $T_P$, the load control module 200 will be reactivated to repeat the operation performed during the time to and the time point $t_8$. Therefore, the electrical equipment 220 may perform diversified control functions under control of the load control module 200 operated in coordination with an operation of the switch 210.

For example, the electrical equipment 220 is assumed to be an illumination apparatus. During the time point $t_0$ and the time point $t_1$, the level of the control voltage $V_{CL}$ received varies continuously, and the illumination apparatus may continuously increase a brightness of its light source according to the level of the control voltage $V_{CL}$, until the turn-on state of the switch 210 is quickly switched, i.e. until the time point $t_1$, along with the quick switching of the switch 210, the brightness of the light source of the illumination apparatus may be switched to one of a plurality of predetermined brightness. Conversely, when the time for the switch 210 being in the turned off state is greater than the predetermined time $T_P$ (for example two seconds), the load control module 200 will be reactivated, such that the brightness of the light source of the illumination apparatus can be adjusted under control of the load control module 200 operated in coordination with the operation of the switch 210.

Accordingly, compared with the conventional techniques, the illumination apparatus can only provide the light source with a fixed brightness under control of the conventional control module 120 operated in coordination with the operation of the switch 210, when the illumination apparatus is activated. However, the brightness of the light source of the illumination apparatus may be adjusted under control of the present control module 200 operated in coordination with the operation of the switch 210, when the illumination apparatus is activated. In other words, the electrical equipment controlled by the switch may perform diversified control functions under control of the load control module 200 of the present embodiment.

Similarly, the electrical equipment 220 is assumed to be a food heater. During the time point $t_0$ and the time point $t_1$, the food heater may continuously increase a temperature of its heat source according to the level of the control voltage $V_{CL}$, until the turn-on state of the switch 210 is quickly switched, i.e. until the time point $t_1$, the temperature of the heat source of the food heater may be switched to one of a plurality of predetermined temperatures under control of the food heater according to the control voltage $V_{CL}$.

Moreover, the electrical equipment 220 is assumed to be an air conditioner. During the time point $t_0$ and the time point $t_1$, the air conditioner may correspondingly decrease the room temperature according to the level of the control voltage $V_{CL}$, until the turn-on state of the switch 210 is quickly switched, i.e. until the time point $t_1$, the room temperature may be switched to one of a plurality of predetermined temperatures under control of the air conditioner according to the control voltage $V_{CL}$.

To fully convey the concept of the invention to those skilled in the art, the inner structures of the energy storage unit 230, the first control unit 240, the second control unit 250 and the signal transforming unit 260 will be further described in detail below.

Figure 4:
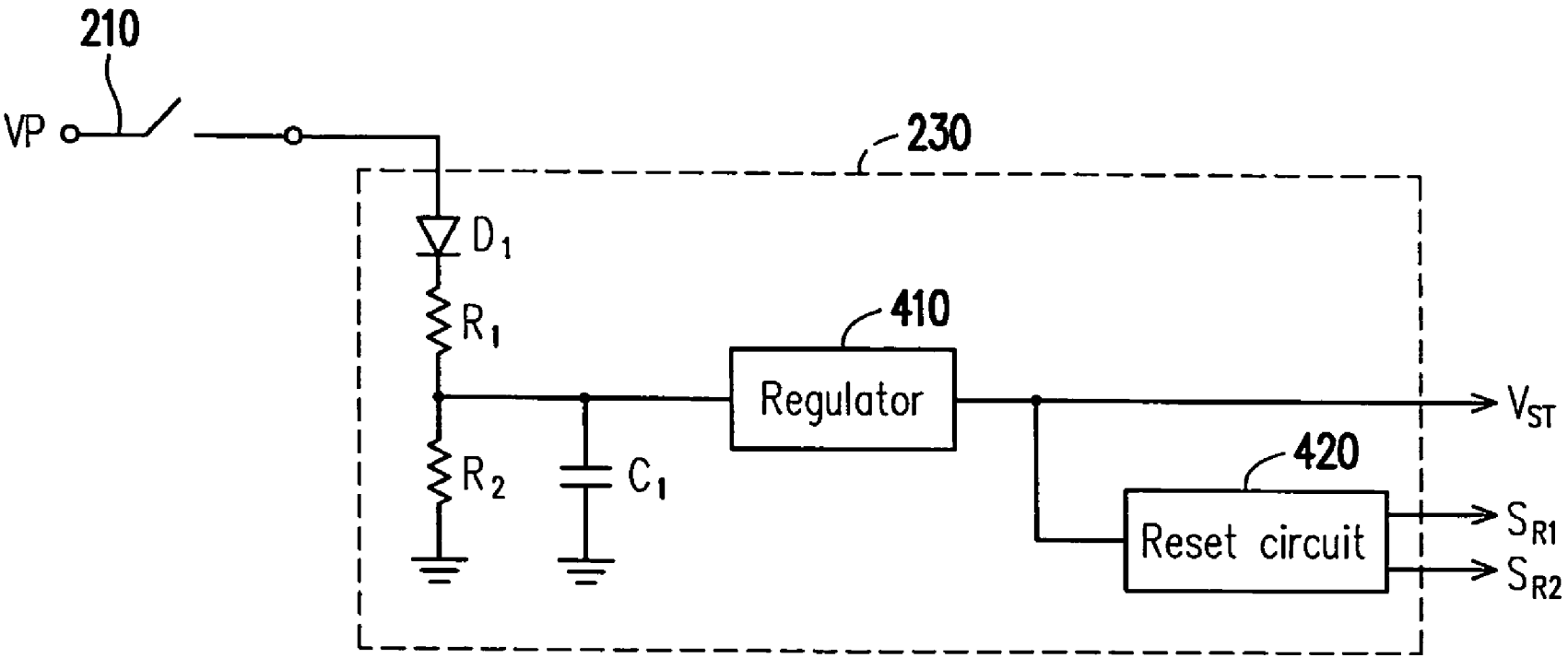
FIG. 4 is a detailed circuit diagram of an energy storage unit according to an embodiment of the present invention.

FIG. 4 is a detailed circuit diagram of an energy storage unit according to an embodiment of the present invention. For convenience, the switch 210 is added to FIG. 4. Referring to FIG. 4, the energy unit 230 includes a diode $D_1$, resistors $R_1$~$R_2$, a capacitor $C_1$, a regulator 410 and a reset circuit 420. An anode of the diode $D_1$ is coupled to the switch 210. A first end of the resistor $R_1$ is coupled to a cathode of the diode $D_1$. The resistor $R_2$ is coupled between a second end of the resistor $R_2$ and the ground. The capacitor $C_1$ is also coupled between the second end of the resistor $R_2$ and the ground. The regulator 410 is coupled to a first end of the resistor $R_2$, and the reset circuit 420 is coupled to the regulator 410.

During operation, when the switch 210 is turned on, the supply voltage VP output from the switch 210 passes through the diode $D_1$ and drops on the resistors $R_1$ and $R_2$. A voltage difference formed by the resistors $R_1$ and $R_2$ is then stored in the capacitor $C_1$, and the regulator 410 then transforms the voltage difference into the reserved voltage $V_{ST}$ and continuously outputs the reserved voltage $V_{ST}$. Conversely, when the switch 210 is turned off, the capacitor $C_1$ discharges the stored voltage difference to the resistor $R_2$ within the predetermined time $T_P$. Therefore, the regulator 410 may still output the reserved voltage $V_{ST}$ for the predetermined time $T_P$, when the switch 210 is turned off. Wherein the predetermined time $T_P$ is determined by a capacitance of the capacitor $C_1$ and a resistance of the resistor $R_2$, and is determined by the regulator 410 and a load there behind. On the other hand, the reset circuit 420 may continuously detect the level of the reserved voltage $V_{ST}$, so as to output the first reset signal $S_{R1}$ during the high transition of the reserved voltage $V_{ST}$, and output the second reset signal $S_{R2}$ when the level of the reserved voltage $V_{ST}$ drops to the threshold value.

Figure 5B:
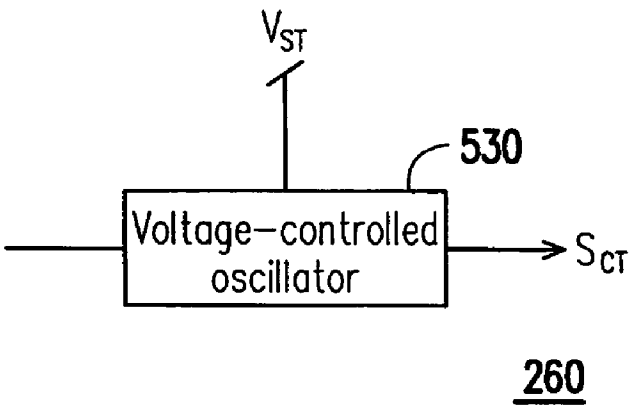
FIGS. 5A and 5B are detailed circuit diagrams respectively illustrating a signal transforming unit according to an embodiment of the present invention.
Figure 5A:
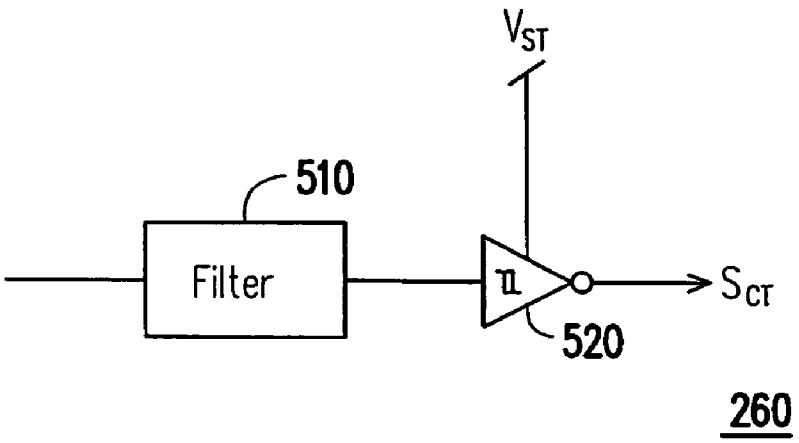

FIGS. 5A and 5B are detailed circuit diagrams respectively illustrating a signal transforming unit according to an embodiment of the present invention. It should be noted that circuit structure of the signal transforming unit 260 can be changed according to an actual requirement of the load control module 200. For example, when the supply voltage VP of an AC signal is applied to the load control module 200, the circuit structure of the signal transforming unit 260 is shown as FIG. 5A, wherein the signal transforming unit 260 includes a filter 510 and a Schmitt trigger 520. The filter 510 is used for filtering a noise of the supply voltage VP. The Schmitt trigger 520 is coupled to the energy unit 230, such that the Schmitt trigger 520 may be activated in response to the reserved voltage $V_{ST}$. Moreover, the Schmitt trigger 520 may transform the filtered supply voltage VP into the counting signal $S_{CT}$ when the Schmitt trigger 520 is activated.

However, when the supply voltage VP of a DC signal is applied to the load control module 200, the signal transforming unit 260 may be composed of a voltage-controlled oscillator (VCO) 530 shown in FIG. 5B. The VCO 530 is coupled to the energy unit 230, such that the Schmitt trigger 520 may be activated in response to the reserved voltage $V_{ST}$. Moreover, the VCO 530 generates the counting signal $S_{CT}$ according to the level of the supply voltage VP when the VCO 530 is activated.

Figure 6:
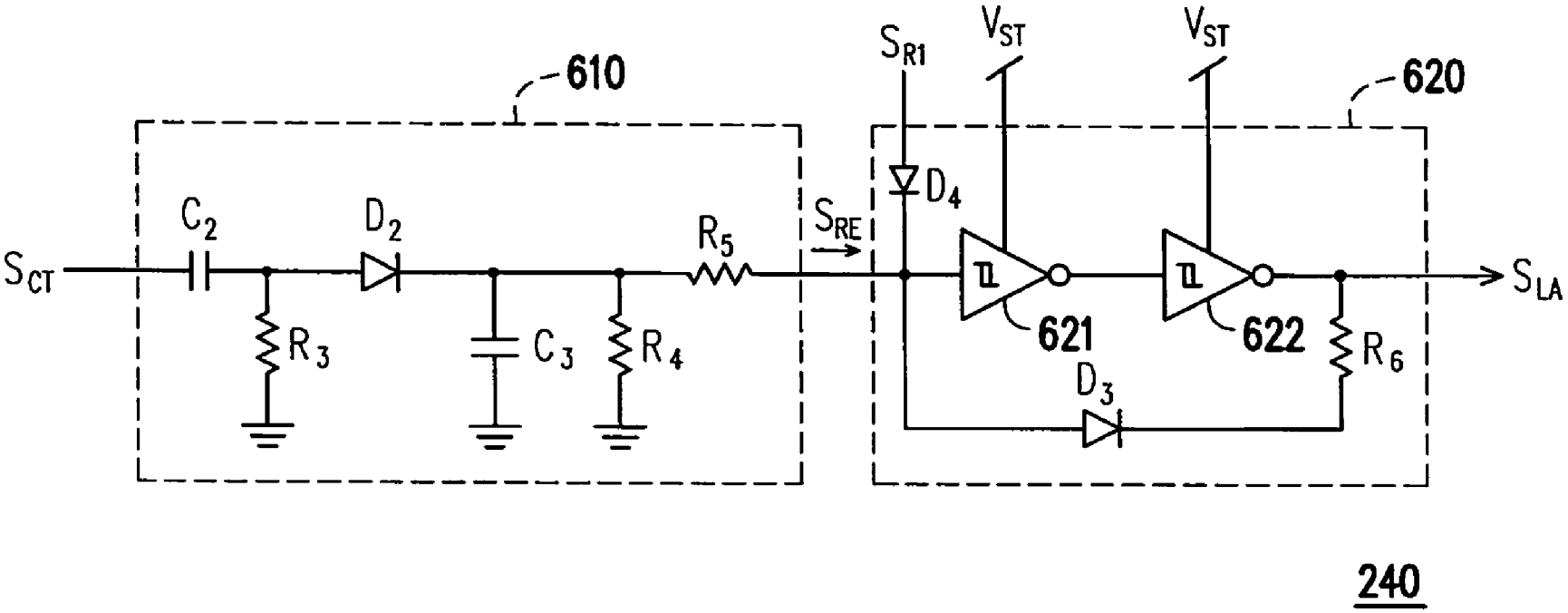
FIG. 6 is a detailed circuit diagram illustrating a first control unit according to an embodiment of the present invention.

FIG. 6 is a detailed circuit diagram illustrating a first control unit according to an embodiment of the present invention. Referring to FIG. 6, the first control unit 240 includes a filtering rectifier unit 610 and a latching unit 620. To fully convey the concept of the invention to those skilled in the art, the inner structures of the filtering rectifier unit 610 and the latching unit 620 will be further described in detail below.

Referring to FIG. 6 again, the filtering rectifier unit 610 includes capacitors $C_2$~$C_3$, a diode $D_2$ and resistors $R_3$~$R_5$. A first end of the capacitor $C_2$ is coupled the signal transforming unit 260. The resistor $R_3$ is coupled between a second end of the capacitor $C_2$ and the ground. An anode of the diode $D_2$ is coupled to the second end of the capacitor $C_2$. The capacitor $C_3$ and the resistor $R_4$ are coupled between a cathode of the diode $D_2$ and the ground, respectively. The resistor $R_5$ is coupled between the cathode of the diode $D_2$ and the latching unit 620.

Referring to FIG. 3 and FIG. 6, operation of the filtering rectifier unit 610 will be described below. During the time point $t_0$ and the time point $t_1$, the filtering rectifier unit 610 may receive the square waves from the counting signal $S_{CT}$, and the capacitor $C_2$ and the resistor $R_3$ may transform the square waves of the counting signal $S_{CT}$ into a plurality of pulses. After being rectified by the diode $D_2$ and being filtered by the resistor $R_4$ and the capacitor $C_3$, the pulse forms the rectified signal $S_{RE}$ having the first level L1. Conversely, during the time point $t_1$ and the time point $t_2$, the filtering rectifier unit 610 cannot receive the square waves from the counting signal $S_{CT}$, and the filtering rectifier unit 610 outputs the rectified signal $S_{RE}$ having the second level L2.

Deduced by analogy, during the time point $t_2$ and the time point $t_6$, the filtering rectifier unit 610 outputs the rectified signal $S_{RE}$ having the first level L1 according to the counting signal $S_{CT}$. Conversely, during the time point $t_6$ and the time point $t_7$, the filtering rectifier unit 610 outputs the rectified signal $S_{RE}$ having the second level L2.

Referring to FIG. 6 again, the latching unit 620 includes Schmitt triggers 621 and 622, diodes $D_3$ and $D_4$, and a resistor $R_6$. The Schmitt triggers 621 and 622 are coupled to each other. An anode of the diode $D_3$ and a cathode of the diode $D_4$ are coupled to the Schmitt trigger 621, respectively. The resistor $R_6$ is coupled between a cathode of the diode $D_3$ and the Schmitt trigger 622.

Referring to FIG. 3 and FIG. 6, operation of the latching unit 620 will be described below. The Schmitt triggers 621 and 622, the diode $D_3$ and the resistor $R_6$ form a feedback circuit. Based on the feedback circuit, when the level of the rectified signal $S_{RE}$ received by the latching unit 620 is switched from the first level L1 to the second level L2, the latching unit 620 latches the level of the clamping signal $S_{LA}$ to the second level L2, until the latching unit 620 receives the first reset signal $S_{R1}$ through the diode $D_4$.

For example, at the time point $t_0$, the level of the clamping signal $S_{LA}$ is switched to the first level L1 in response to the first reset signal $S_{R1}$ received by the diode $D_4$. Then, during the time point $t_0$ and the time point $t_1$, the latching unit 620 receives the rectified signal $S_{RE}$ having the first level L1 and outputs the clamping signal $S_{LA}$ having the first level L1. However, at the time point $t_1$, since the level of the rectified signal $S_{RE}$ is switched from the first level L1 to the second level L2, the latching unit 620 latches the level of the clamping signal $S_{LA}$ to the second level L2, and until the time point $t_8$, the latching unit 620 will again switch the level of the clamping signal $S_{LA}$ to the first level L1 according to the first reset signal $S_{R1}$.

Figure 7:
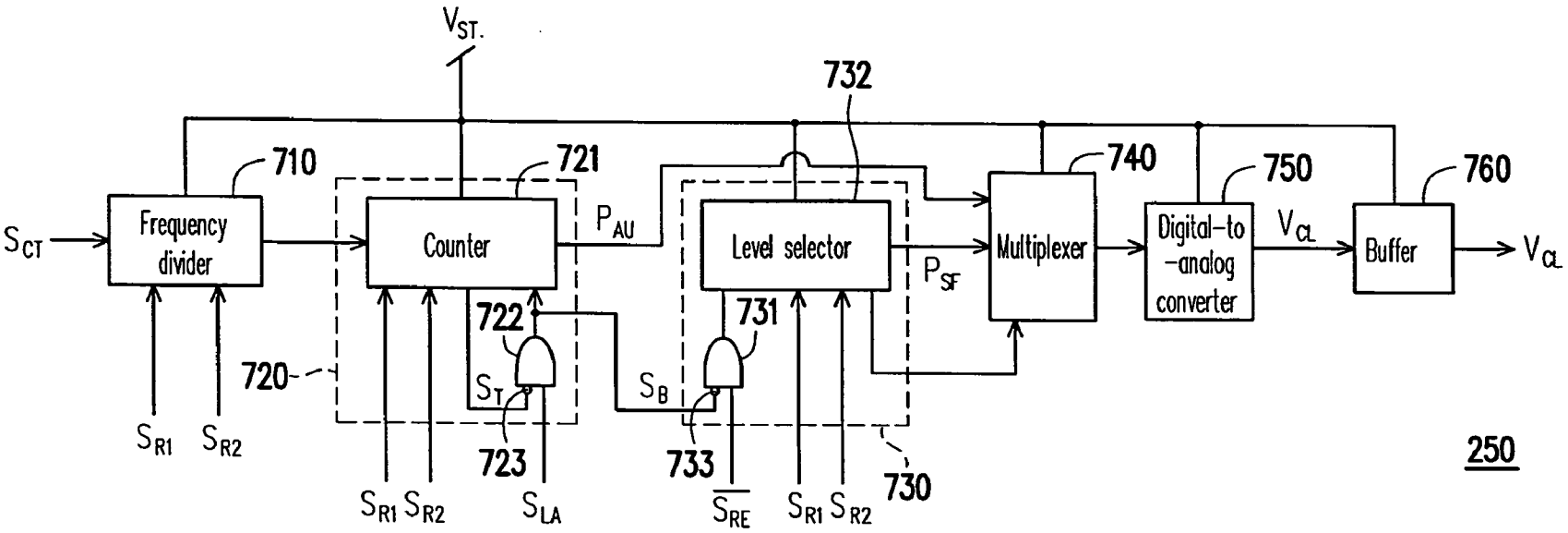
FIG. 7 is a detailed circuit diagram illustrating a second control unit according to an embodiment of the present invention.

FIG. 7 is a detailed circuit diagram illustrating a second control unit according to an embodiment of the present invention. Referring to FIG. 7, the second control unit 250 includes a frequency divider 710, a counting unit 720, a rough adjusting unit 730, a multiplexer 740, a digital-to-analog converter 750 and a buffer 760. The frequency divider 710 is coupled to the signal transforming unit 260. The counting unit 720 is coupled to the frequency divider 710. The rough adjusting unit 730 is coupled to the counting unit 720 and the first control unit 240. The multiplexer 740 is coupled to the counting unit 720, the rough adjusting unit 730 and the first control unit 240. The digital-to-analog converter 750 is coupled between the counting unit 720 and the buffer 760.

Referring to FIG. 3 and FIG. 7, during operation, the frequency divider 710, the counting unit 720, the rough adjusting unit 730, the multiplexer 740, the digital-to-analog converter 750 and the buffer 760 are respectively coupled to the energy unit 230, and are driven by the reserved voltage $V_{ST}$. Moreover, the frequency divider 710 divides the frequency of the counting signal $S_{CT}$ into a specific frequency when the frequency divider 710 is activated, so as to output a square wave signal $S_{RW}$. For example, in the present embodiment, the frequency divider 710 divides the frequency of the counting signal $S_{CT}$ with 3 to generate the square wave signal $S_{RW}$ shown as FIG. 3.

The counting unit 720 includes a counter 721, an AND gate 722 and an inverter 723. The counter 721 counts an accumulated value $P_{AU}$ up to the predetermined value according to the square wave signal $S_{RW}$ when the counter 721 is activated, and outputs a state signal $S_T$ having the first level L1 when counting up to the predetermined value. On the other hand, one end of the AND gate 722 receives an inverted signal of the state signal $S_T$ through the inverter 723, and another end of the AND gate 722 receives the clamping signal $S_{LA}$. With variation of the state signal $S_T$ and the clamping signal $S_{LA}$, the AND gate 722 outputs an interrupt signal $S_B$ to the counter 721. It should be noted that when the level of the interrupt signal $S_B$ is the second level L2 (for example logic 0), the counter 721 stops counting. Namely, when one of the clamping signal $S_{LA}$ and the inverted signal of the state signal $S_T$ has the second level L2 (for example logic 0), the counter 721 stops counting.

The rough adjusting unit 730 includes an AND gate 731, a level selector 732 and an inverter 733. One end of the AND gate 731 receives an inverted signal of the interrupt signal $S_B$ through the inverter 733, and another end of the AND gate 731 receives the inverted signal $/S_{RE}$ of the rectified signal. When the inverted signal of the interrupt signal $S_B$ and the inverted signal $/S_{RE}$ of the rectified signal are simultaneously switched to the first level (for example logic 1), the AND gate 731 outputs an enable signal. The level selector 732 selects one of a plurality of level adjusting values to be a specific adjusting value $P_{SF}$ when the enable signal is received, and outputs the specific adjusting value $P_{SF}$ and a control signal to the multiplexer 740. In other words, when the interrupt signal $S_B$ is switched to the second level L2 (for example logic 0), namely, when the counter 721 stops counting, the level selector 732 outputs the specific adjusting value $P_{SF}$ and the control signal to the multiplexer 740, as long as the inverted signal $/S_{RE}$ of the rectified signal is switched to the first level L1 (for example logic 1).

On the other hand, the multiplexer 740 receives the accumulated value $P_{AU}$ and the specific adjusting value $P_{SF}$. When the multiplexer 740 receives the control signal output from the level selector 732, the multiplexer 740 outputs the specific adjusting value $P_{SF}$ to the digital-to-analog converter 750. Conversely, the multiplexer 740 outputs the accumulated value $P_{AU}$ to the digital-to-analog converter 750. In other words, the digital-to-analog converter 750 receives the accumulated value $P_{AU}$ output from the counter 721, or receives the specific adjusting value $P_{SF}$ output from the level selector 732. Then, the digital-to-analog converter 750 converts the level of the control voltage $V_{CL}$ according to the received value.

For example, as shown in FIG. 3, during the time point $t_0$ and the time point $t_1$, since the clamping signal $S_{LA}$ maintains the first level L1, the counter 721 may continuously increase or decrease the accumulated value $P_{AU}$. Accordingly, the digital-to-analog converter 750 may control the level of the control voltage $V_{CL}$ according to the value variation of the accumulated value $P_{AU}$. However, if the accumulated value $P_{AU}$ is not counted up to the predetermined value during the time point $t_0$ and the time point $t_1$, with the quick switching of the switch 210 in response to the switching signal S21 during the time point $t_1$ and the time point $t_2$, the counter 721 stops counting according to the clamping signal $S_{LA}$ having the second level L2, and the multiplexer 740 outputs the accumulated value $P_{AU}$ having a fixed value to the digital-to-analog converter 750 during the time point $t_2$ and the time point $t_3$. Therefore, shown as the curve CV1, the level of the control voltage VCL maintains a fixed level during the time point $t_1$ and the time point $t_3$.

On the other hand, if the accumulated value $P_{AU}$ is counted up to the predetermined value during the time point $t_0$ and the time point $t_1$, namely, the interrupt signal $S_B$ is switched to the second level L2 (for example logic 0) after the time point $t_1$, the multiplexer 740 outputs the specific adjusting value $P_{SF}$ to the digital-to-analog converter 750 during the time point $t_2$ and the time point $t_3$ with the quick switching of the switch 210,. Since the level adjusting values in the level selector 732 respectively correspond to the predetermined levels LAT1~LAT3, the level of the control voltage $V_{CL}$ is switched to one of the predetermined levels LAT1~LAT3 during the time point $t_2$ and the time point $t_3$, shown as the curve CV2.

Furthermore, the buffer 760 is coupled between the digital-to-analog converter 750 and the electrical equipment 220, and is used for buffering and outputting the control voltage $V_{CL}$ output from the digital-to-analog converter 750 when the buffer is activated. It should be noted that the counter 721, the level selector 732 and the buffer 760 are further coupled to the energy storage unit 230, and are driven by the reserved voltage $V_{ST}$. Moreover, the frequency divider 710, the counter 721 and the level selector 732 may further receive the first reset signal SRI and the second reset signal $S_{R2}$ output from the energy storage unit 230, such that the counter 721 may re-perform a counting operation according to the first reset signal $S_{R1}$ and the second reset signal $S_{R2}$; the frequency divider 710 may re-perform a dividing operation according to the first reset signal $S_{R1}$ and the second reset signal $S_{R2}$; and the level selector 732 may be reset according to the first reset signal $S_{R1}$ and the second reset signal $S_{R2}$.

In summary, in the present invention, the load control module may still operate continuously for a predetermined time under control of the energy storage unit when the switch is turned off. The signal transforming unit, the first control unit and the second control unit are driven by the reserved voltage. With a different switching speed of the switch, the second control unit may operate in coordination with the actions of the signal transforming unit and the first control unit to regulate the level of the control voltage, or maintain the level of the control voltage in the current state. Therefore, the electrical equipments may perform diversified control functions under control of the load control module operated in coordination with the operation of the switch.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A load control module, for an electrical equipment, wherein the electrical equipment is controlled by an operation of a switch, the load control module comprising:

an energy storage unit, for converting a supply voltage and outputting a reserved voltage when the switch is turned on, and continuously outputting the reserved voltage for a predetermined time when the switch is turned off;

a signal transforming unit, coupled to the energy storage unit, and driven by the reserved voltage, configured to transform the supply voltage output from the switch into a counting signal;

a first control unit, coupled to the energy storage unit and the signal transforming unit, and driven by the reserved voltage, configured to filter and rectify the counting signal to output a rectified signal, wherein when a level of the rectified signal is switched to a second level, the first control unit latches the level of a clamping signal to the second level, and until the first control unit is reactivated, the first control unit then outputs the clamping signal having a first level; and a second control unit, coupled to the energy unit, the signal transforming unit, the first control unit and the electrical equipment, and driven by the reserved voltage, configured to output a control voltage to control characteristic parameters of the electrical equipment, wherein when the second control unit receives the clamping signal having the first level, the second control unit counts continuously in response to the counting signal, so as to adjust the level of the control voltage according to a counting result, and when the second control unit counts up to a predetermined value or receives the clamping signal having the second level, the second control unit stops counting, the level of the control voltage is switched to one of a plurality of predetermined levels according to an inverted signal of the rectified signal.

2. The load control module as claimed in claim 1, wherein the second control unit comprises:

a frequency divider, coupled to the signal transforming unit, configured to divide a frequency of the counting signal into a specific frequency to output a square wave signal when the frequency divider is activated;

a counting unit, coupled to the frequency divider and the first control unit, configured to count an accumulated value up to the predetermined value according to the square wave signal when the counting unit is activated, wherein when the counting unit counts up to the predetermined value or receives the clamping signal having the second level, the counting unit stops counting and generates an interrupt signal having the second level;

a rough adjusting unit, coupled to the counting unit and the first control unit, determining to output one of a plurality of predetermined level adjusting values according to the inverted signal of the rectified signal and the interrupt signal, so as to generate a specific adjusting value and a control signal, when the rough adjusting unit is activated, wherein the level adjusting values respectively correspond to the predetermined levels;

a multiplexer, coupled to the counting unit and the rough adjusting unit, configured to output the specific adjusting value when the multiplexer receives the control signal, and conversely, output the accumulated value; and a digital-to-analog converter, coupled to the multiplexer, configured to output the control voltage, and convert the level of the control voltage according to the accumulated value or the specific adjusting value, when the digital-to-analog converter is activated, wherein the frequency divider, the counting unit, the rough adjusting unit, the multiplexer and the digital-to-analog converter are respectively coupled to the energy unit, and are driven by the reserved voltage.

3. The load control module as claimed in claim 2, wherein the second control unit further comprises:

a buffer, coupled to the energy storage unit, the digital-to-analog converter and the electrical equipment, and driven by the reserved voltage, configured to buffer and output the control voltage when the buffer is activated.

4. The load control module as claimed in claim 2, wherein the counting unit comprises:

a counter, coupled to the energy storage unit and the frequency divider, and driven by the reserved voltage, configured to count the accumulated value up to the predetermined value according to the square wave signal when the counter is activated, and generate a state signal having the first level when counting up to the predetermined value; and a first AND gate, for receiving the clamping signal and an inverted signal of the state signal to generate the interrupt signal, wherein when the interrupt signal has the second level, the counter stops counting.

5. The load control module as claimed in claim 2, wherein the rough adjusting unit comprises:

a second AND gate, for generating an enable signal when the interrupt signal and the inverted signal of the rectified signal have the first level; and a level selector, coupled to the energy storage unit and the second AND gate, and driven by the reserved voltage, configured to select one of the level adjusting values to be the specific adjusting value according to the enable signal when the level selector is activated, so as to generate the control signal.

6. The load control module as claimed in claim 1, wherein the energy storage unit further outputs a first reset signal during high transition of the reserved voltage, and outputs a second reset signal when the level of the reserved voltage drops to a threshold value, wherein the first control unit switches the level of the clamping signal to the first level according to the first reset signal, and the second control unit is reset according to the first reset signal or the second reset signal.

7. The load control module as claimed in claim 6, wherein the energy storage unit comprises:

a first diode, with an anode of the first diode coupled to the switch;

a first resistor, with a first end of the first resistor coupled to a cathode of the first diode;

a second resistor, with a first end of the second resistor coupled to a second end of the first resistor, and a second end of the second resistor coupled to the ground;

a first capacitor, with a first end of the first capacitor coupled to the second end of the first resistor, and a second end of the first capacitor coupled to the ground;

a regulator, coupled to the first end of the second resistor, configured to output the reserved voltage; and a reset circuit, coupled to the regulator, for detecting a level of the reserved voltage, so as to output the first reset signal during the high transition of the reserved voltage, and output the second reset signal when the level of the reserved voltage drops to the threshold value.

8. The load control module as claimed in claim 1, wherein the first control unit comprises:

a filtering rectifier unit, coupled to the signal transforming unit, for filtering and rectifying the counting signal to output the rectified signal; and a latching unit, coupled to the energy storage unit and the filtering rectifier unit, for outputting the clamping unit according to the rectified signal when the latching unit is activated, wherein when the level of the rectified signal is switched from the first level to the second level, the latching unit latches the level of the clamping signal to the second level, until the latching unit is reactivated.

9. The load control module as claimed in claim 8, wherein the filtering rectifier unit comprises:

a second capacitor, with a first end of the second capacitor coupled to the signal transforming unit;

a third resistor, with a first end of the third resistor coupled to a second end of the second capacitor, and a second end of the third resistor coupled to the ground;

a second diode, with an anode of the second diode coupled to the second end of the second capacitor;

a third capacitor, with a first end of the third capacitor coupled to a cathode of the second diode, and a second end of the third capacitor coupled to the ground;

a fourth resistor, with a first end of the fourth resistor coupled to the cathode of the second diode, and a second end of the fourth resistor coupled to the ground; and a fifth resistor, with a first end of the fifth resistor coupled to the cathode of the second diode, and a second end of the fifth resistor being used for outputting the clamping signal.

10. The load control module as claimed in claim 8, wherein the latching unit comprises:

a third diode, with an anode of the third diode coupled to the energy storage unit;

a second Schmitt trigger, coupled to the energy storage unit, the filtering rectifier unit and a cathode of the third diode, and driven by the reserved voltage;

a third Schmitt trigger, coupled to the energy storage unit and the second Schmitt trigger, and driven by the reserved voltage;

a fourth diode, with an anode of the fourth diode coupled to the second Schmitt trigger; and a sixth resistor, with a first end of the sixth resistor coupled to the cathode of the third diode, and a second end of the sixth resistor couple to the third Schmitt trigger.

11. The load control module as claimed in claim 1, wherein when the supply voltage is an AC signal, the signal transforming unit comprises:

a filter, for filtering a noise of the supply voltage; and a first Schmitt trigger, coupled to the energy storage unit and the filter, and driven by the reserved voltage, configured to covert the filtered supply voltage into the counting signal.

12. The load control module as claimed in claim 1, wherein when the supply voltage is a DC signal, the signal transforming unit is a voltage-controlled oscillator, and the voltage-controlled oscillator is coupled to the energy unit, and is driven by the reserved voltage.

* * * * *